US007816995B1

(12) United States Patent
Allen et al.

(10) Patent No.: US 7,816,995 B1
(45) Date of Patent: Oct. 19, 2010

(54) CIRCULATOR CANCELLER WITH INCREASED CHANNEL ISOLATION

(75) Inventors: Jeffery C. Allen, San Diego, CA (US); John W. Rockway, San Diego, CA (US); Diana Arceo, San Diego, CA (US); Jeffery Young, Moscow, ID (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 120 days.

(21) Appl. No.: 12/399,316

(22) Filed: Mar. 6, 2009

(51) Int. Cl.
*H01P 1/32* (2006.01)
*H01P 1/38* (2006.01)

(52) U.S. Cl. ..... 333/1.1; 455/73

(58) Field of Classification Search ..... 333/1.1, 333/24.2; 455/78, 73, 205
See application file for complete search history.

(56) References Cited

U.S. PATENT DOCUMENTS 3,729,692 A * 4/1973 Tanaka et al. ..... 333/1.1
4,641,365 A * 2/1987 Montini, Jr. ..... 455/78
6,374,094 B1 * 4/2002 Zappala ..... 455/188.1
7,719,384 B1 * 5/2010 Arceo et al. ..... 333/132
2008/0169878 A1 * 7/2008 Resnati et al. ..... 333/1.1

* cited by examiner

*Primary Examiner*—Stephen E Jones
(74) *Attorney, Agent, or Firm*—Ryan J. Friedl; Kyle Eppele

(57) ABSTRACT

A system includes a first circulator, a second circulator connected to the first circulator and a load, a third circulator connected to the second circulator, and a filter connected between the first and third circulators. The filter modifies the phase and amplitude of a first signal from the first circulator to produce a modified first signal. The modified first signal amplitude may be equal to the amplitude of a second signal from the second circulator. The phase of the modified first signal is about 180 degrees out of phase with the second signal phase. The third circulator circulates the modified first signal towards the second circulator. The first signal comprises a coupled signal from the first circulator. The second signal comprises a signal reflected from the load and a coupled signal from the second circulator. The filter may be a passive network having lumped, distributed, and resistive elements.

20 Claims, 7 Drawing Sheets

CIRCULATOR CANCELLER WITH INCREASED CHANNEL ISOLATION

FEDERALLY SPONSORED RESEARCH AND DEVELOPMENT

The Circulator Canceller with Increased Channel Isolation is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case No. 99245.

BACKGROUND

In many applications, it is desirable to have a common broadband transmit and receive antenna. A circulator may be used to provide isolation between transmit and receive subsystems using a common antenna. However, due to antenna reflectance, a circulator does not fully provide isolation between transmit and receive subsystems. Even with the use of matching networks, antenna reflectance cannot completely be eliminated. Therefore, there is a need for a device that can increase the transmit-to-receive isolation of a system using a common antenna.

DETAILED DESCRIPTION OF SOME EMBODIMENTS

Figure 1:
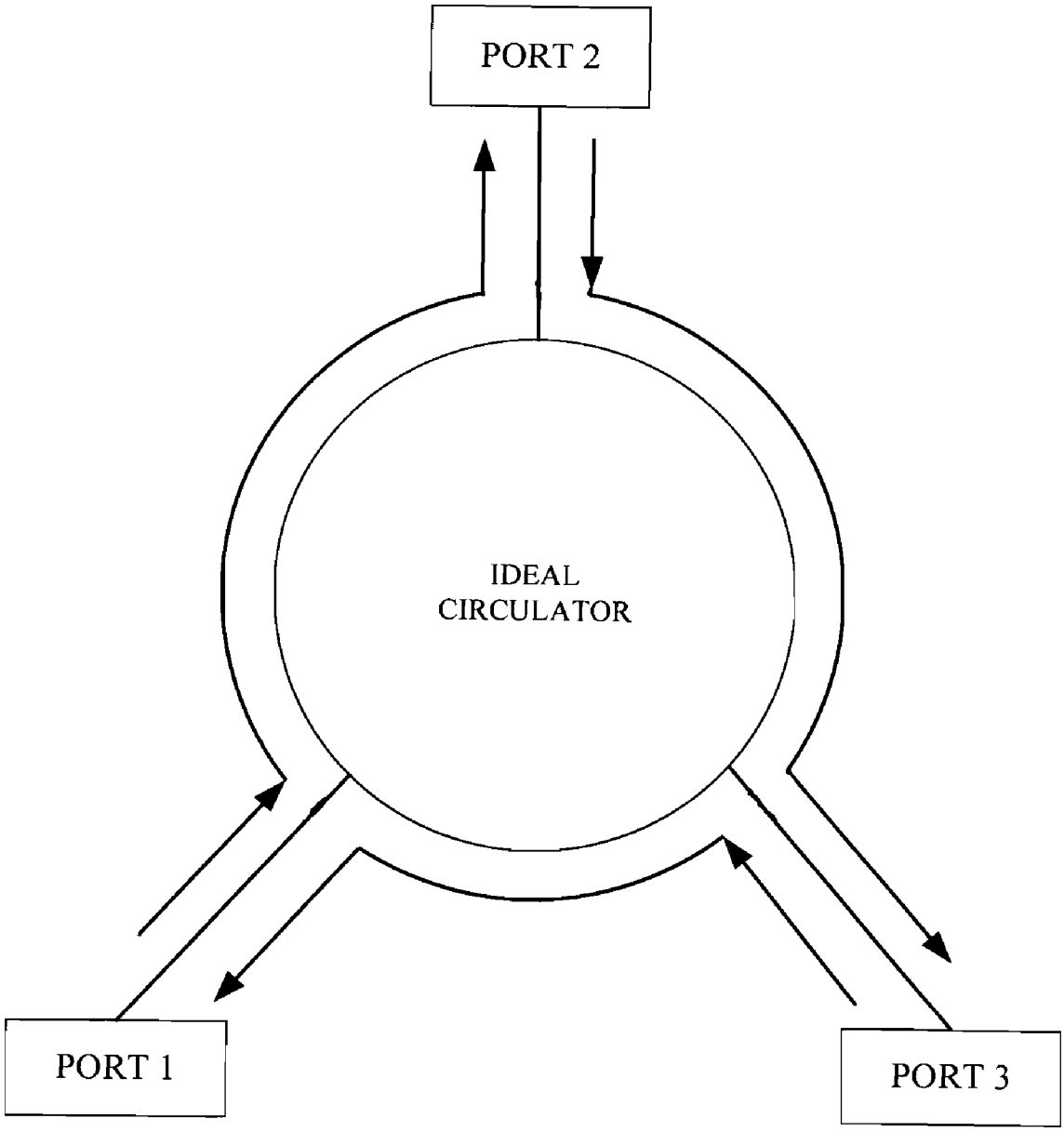
FIG. 1 shows a diagram of an ideal three-port circulator.

FIG. 1 shows a diagram of an ideal three-port circulator. As indicated by the arrows, ideal circulators output all of the power that flows into Port 1 to Port 2 (likewise for Port 2 to Port 3 and for Port 3 to Port 1). Actual circulators depart from this ideal circulation, as some power is reflected from the mismatch of the attached load, some power is dissipated in the circulator, and some power is leaked to the unintended port. These departures from the ideal are measured by three functions: return loss, insertion loss, and isolation.

In an actual circulator, not all of the power can flow into the load at the port, as a fraction of the power is reflected back. The ratio of the input power to the reflected power is referred to as return loss. A well designed circulator "returns" as little power as possible. An ideal circulator has an infinite return loss since no power is reflected back. A return loss in excess of 14 dB is credible for actual circulators. In an ideal circulator, all of the power fed into a port is delivered to the adjacent port. In an actual circulator, a fraction of the power delivered is dissipated within the circulator, and this is measured as the insertion loss. A well designed circulator "inserts" most of the power to the desired port so has a small insertion loss. An ideal circulator has an insertion loss of 0 dB. An insertion loss of 0.5 dB is credible for an actual circulator. In an actual circulator, a small portion of the power delivered flows into an isolation port. The ratio of the input power to the Port 1 to power exiting Port 3 is called the isolation. An ideal circulator has infinite isolation. An isolation of 20 dB is good for an actual circulator.

Figure 2:
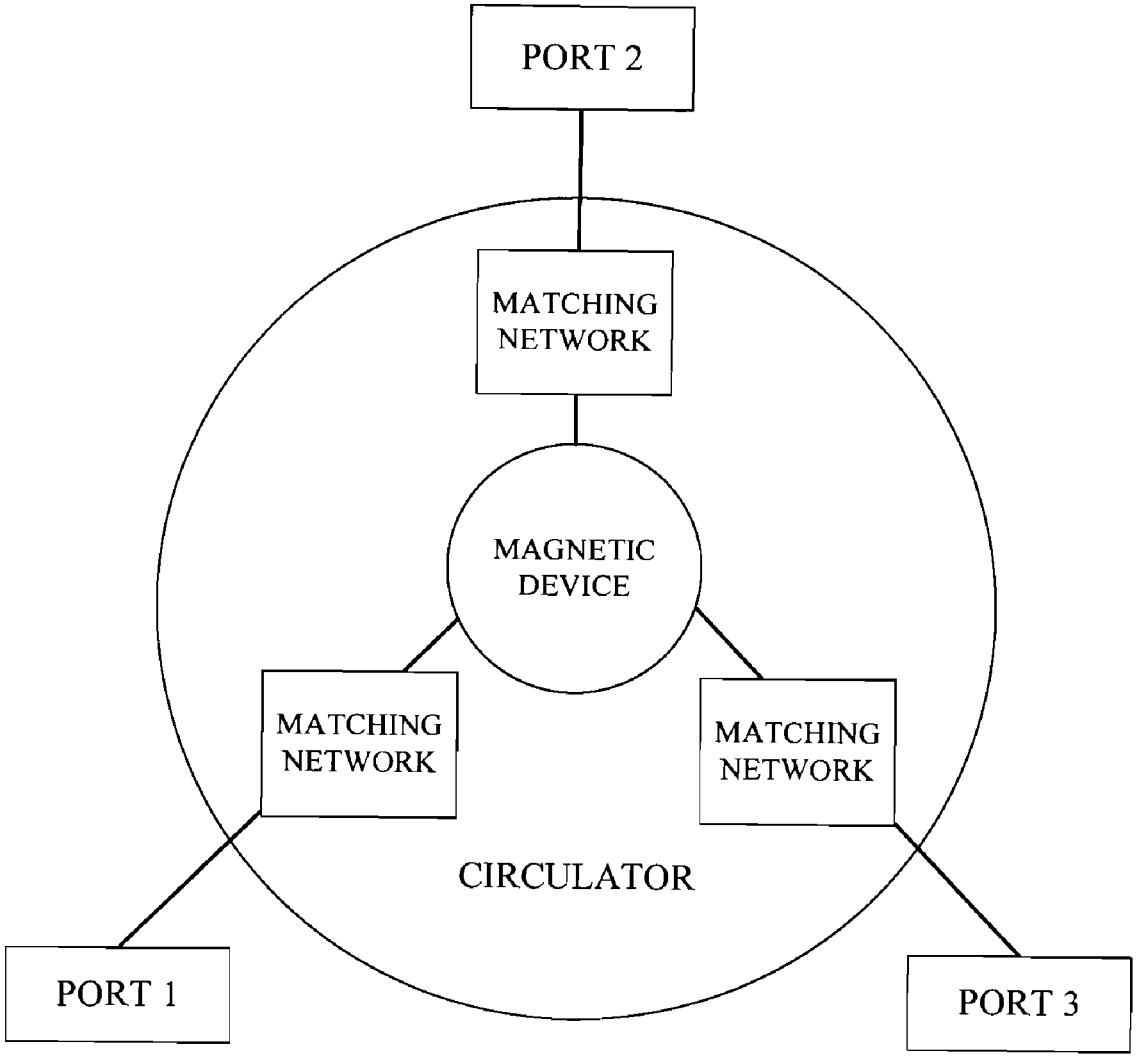
FIG. 2 shows a diagram of a typical ferrite three-port circulator design.

FIG. 2 shows a diagram of a typical ferrite three-port circulator design. The circulator contains a device using magnetized material and matching networks to connect the circulator to a first, second, and third port. The first port is connected to a transmitter, the second port is connected to an antenna, and the third port is connected to a receiver. The device is comprised of magnetized material which controls the signal flow, and matching networks that match the impedance of the circulator to the impedance of the device attached to each of the ports. For clockwise circulators, the signal will flow from Port 1 to Port 2, from Port 2 to Port 3, and from Port 3 to Port 1. Isolation will exist from Port 1 to 3, Port 2 to 1, and Port 3 to 2.

Two common applications of three-port circulators are duplexers and isolators. As a duplexer, the circulator has Port 1 connected to a transmitter, Port 2 connected to an antenna, and Port 3 connected to a receiver. The transmitter delivers power to the antenna, the antenna delivers its received signal to the receiver, and the transmitter is isolated from the receiver. Consequently, the transmitter and the receiver may simultaneously share a common antenna. In isolator applications, Port 1 may be a transmitter, Port 2 a device with a poor mismatch loss, and Port 3 with a termination load. Within this configuration, power transmitted to a device with a poor mismatch loss will shunt all of its reflected power into the termination load, preventing any power returning to the transmitter.

Generally, all circulator configurations are limited to the amount of isolation that can be provided by the device due to mismatched loads connected to the ports. For example, in a duplexer configuration, the antenna has a reflectance. The reflectance from the antenna limits the circulator isolation since the antenna will reflect power from the adjacent port to the non-adjacent port. Traditionally, the matching network in the circulator is designed to minimize the reflectance of the antenna or any other device attached to the circulator. No provision is made to minimize the reflectance of the devices attached to the circulator by passive cancelling of the reflected signal.

Figure 3:
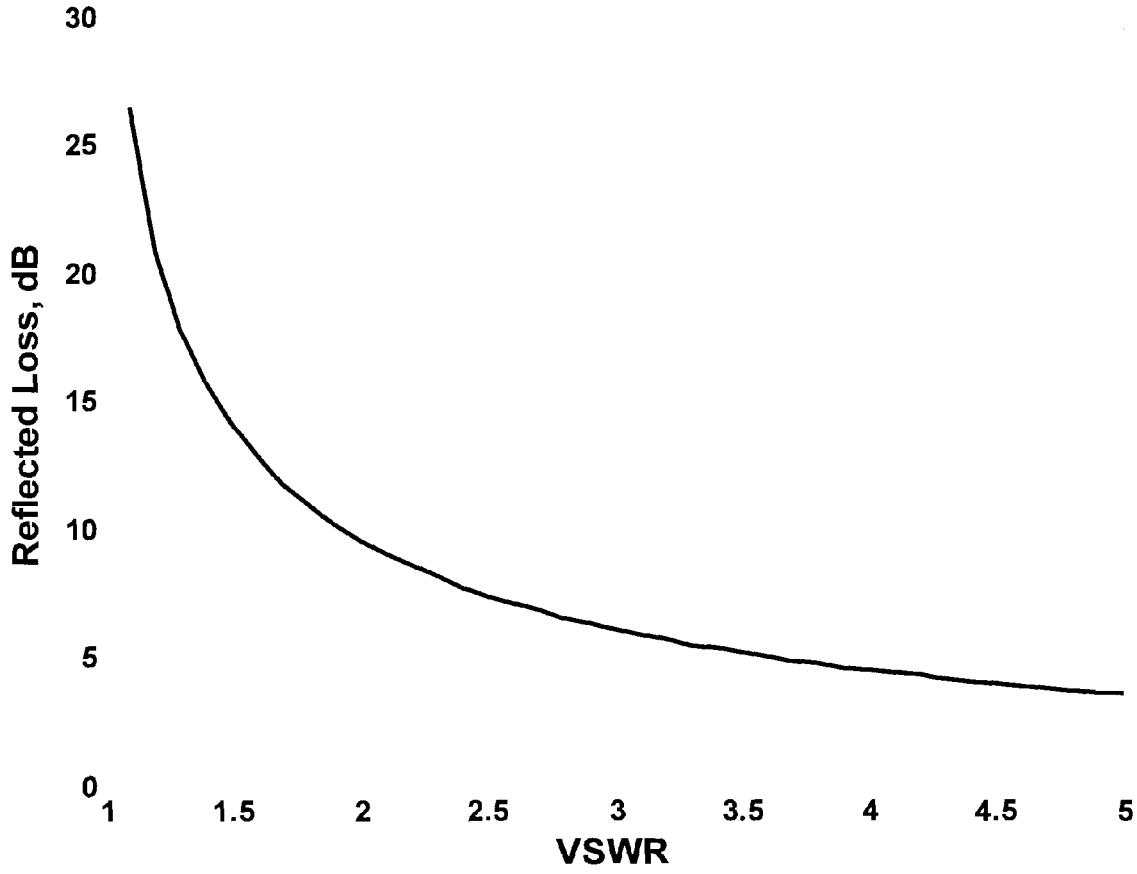
FIG. 3 shows a graph of return loss in dB as a function of the Voltage Standing Wave Ratio (VSWR).
Figure 4:
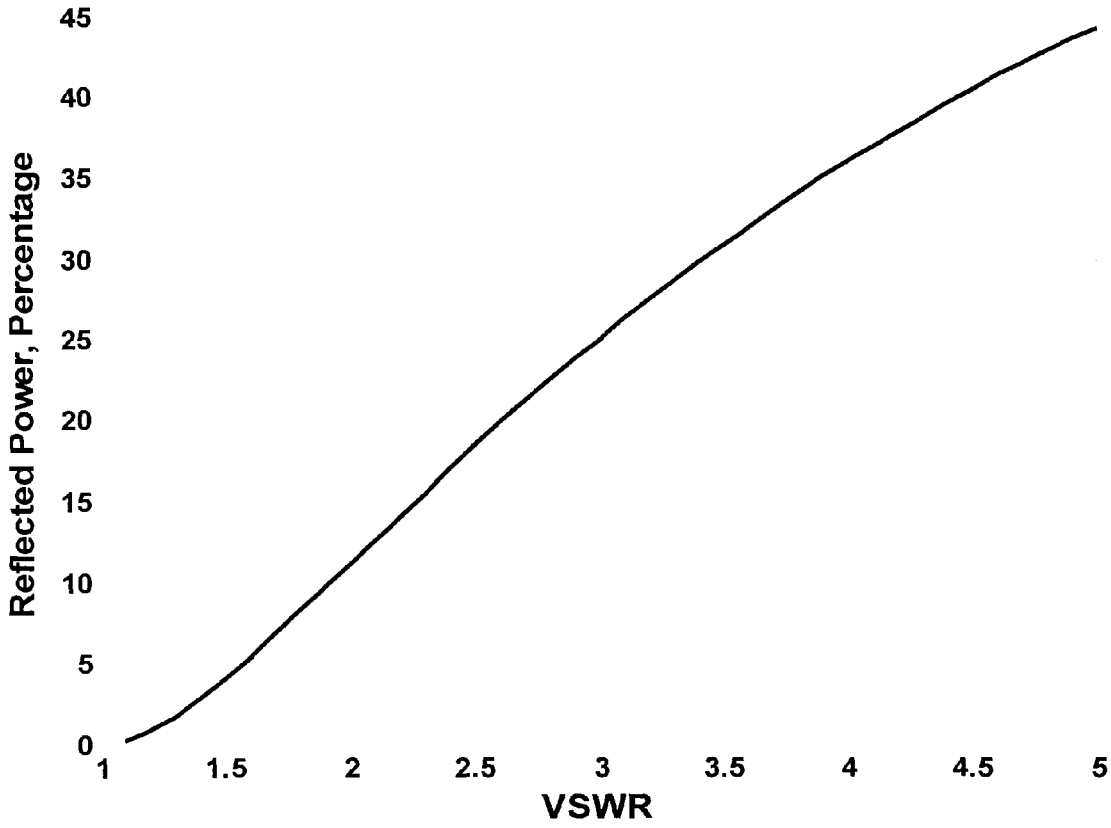
FIG. 4 shows a graph of reflected power as a as a percentage of the input power to an antenna as a function of the VSWR.

Referring to FIGS. 3 and 4, FIG. 3 shows a graph of return loss in dB as a function of VSWR, while FIG. 4 shows a graph of reflected power in percentage as a function of VSWR, for a device connected to a duplexer implemented using circulator technology. The VSWR is a measure of how well the device is matched to the source. The value of VSWR is always expressed as a ratio with 1 in the denominator. A perfect match corresponds to a VSWR of 1:1, but in practice this is not achievable. Perfect impedance matching means that there is maximum power transfer from source to load. The relationship between return loss and the VSWR is given by the following equation:

$$\text{Reflected Loss} = -20\ \text{Log}_{10}\left(\frac{VSWR-1}{VSWR+1}\right)$$

For broadband devices, it is difficult to achieve a VSWR across the operating band of the antenna less than 2:1. For antennas, the VSWR requirement may vary from 4:1 to 2:1 depending on the transmitter used. Table 1 shows the return loss in dB and the reflected power as a percentage of the input power.

TABLE 1

| VSWR | Return Loss (dB) | Reflected Power (%) |
|---|---|---|
| 2 | 9.52 | 11.1 |
| 2.5 | 7.36 | 18.4 |
| 3 | 6.02 | 25.0 |
| 3.5 | 5.10 | 30.9 |
| 4.0 | 4.44 | 36 |

Considering the typical ferrite three-port circulator design of FIG. 2, this reflected power from the antenna or device will proceed back through Port 2 to Port 3. The reflected power from the antenna or device at port 2 will be delivered to the receive subsystem at port 3. The circulator minimizes the power between Port 1 and Port 3. Such minimization is of limited value when the reflected power from the device or antenna is greater than the power flowing from Port 1 and Port 3.

Figure 5:
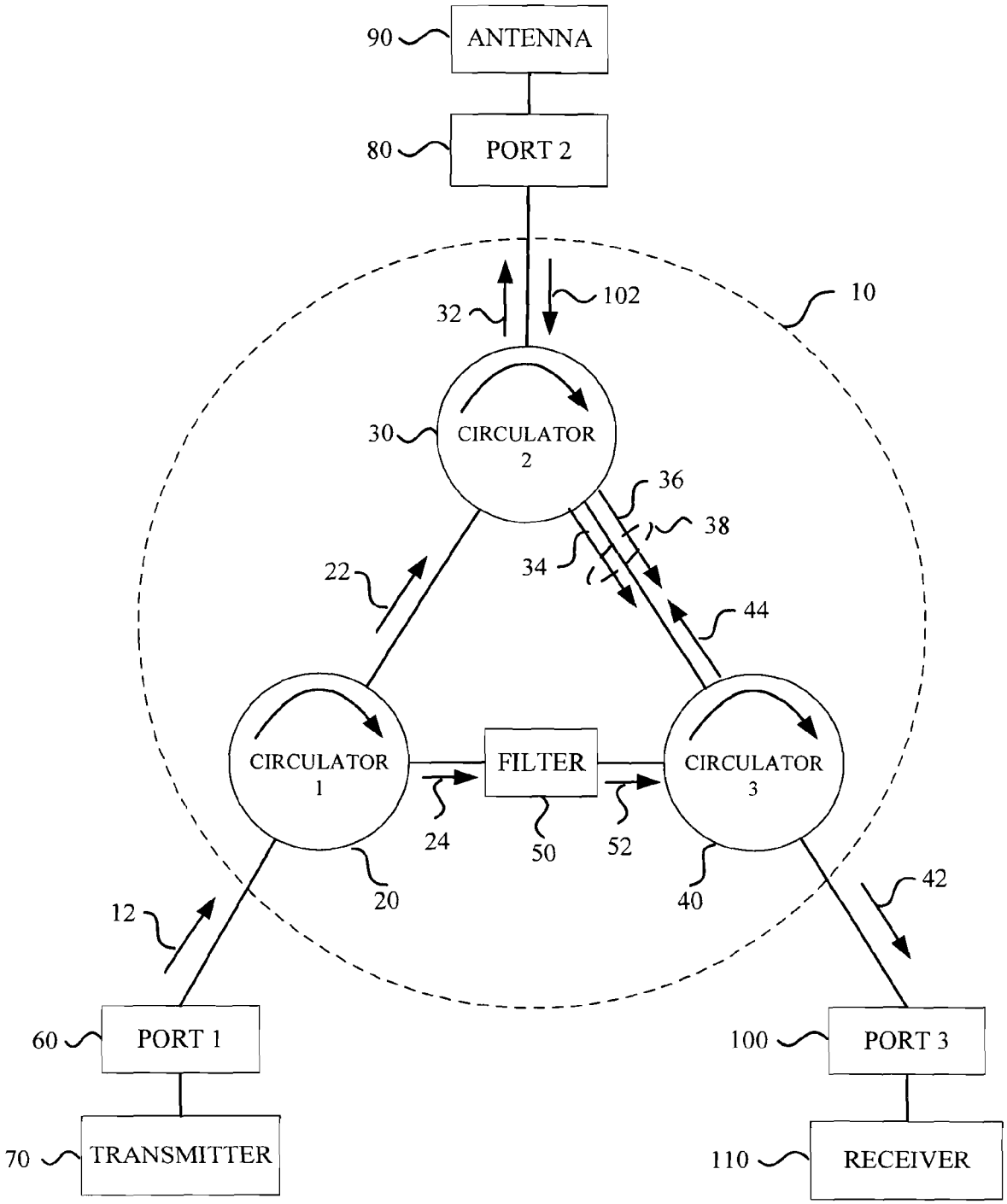
FIG. 5 shows a diagram of an embodiment of a system in accordance with the Circulator Canceller with Increased Channel Isolation.

FIG. 5 shows a diagram of an embodiment of a system 10 in accordance with the Circulator Canceller with Increased Channel Isolation. System 10 is configured to minimize the reflectance of the devices attached to the circulator by cancelling the reflected signal from the load. System 10 includes a first circulator 20, a second circulator 30, a third circulator 40, and a filter 50. As an example, first circulator 20, second circulator 30, and third circulator 40 are three-port clockwise circulators, such as those manufactured by the EMR Corporation, model number 7340/0. In other embodiments, first circulator 20, second circulator 30, and third circulator 40 are broadband channelized circulators, such as the circulators described in U.S. patent application Ser. No. 12/237,592, entitled "Broadband Channelized Circulator", to Arceo et al. In some embodiments, system 10 may be configured to operate with counter-clockwise circulators and/or circulators having more than three ports.

First circulator 20 is connected to second circulator 30, filter 50, and may be connected to a first port 60, which may be connected to a transmitter 70. Second circulator 30 may be connected to a second port 80, which may be connected to a load 90, such as an antenna. Third circulator 40 is connected to second circulator 30, filter 50, and may be connected to a third port 100, which may be connected to a receiver 110. Filter 50 is connected between first circulator 20 and third circulator 40.

In operation, a signal 12 is input to system 10 from transmitter 70, through first port 60, to the input port of first circulator 20. First circulator 20 then, via a second port, outputs a signal 22 to second circulator 30. Due to the imperfect isolation of currently available ferrite circulators, a signal 24, which represents a portion of signal 12, is leaked out of a third port of first circulator 20 to filter 50. Second circulator 30 receives signal 22 via a first port, then, via a second port, outputs a signal 32 to second port 80. Second port 80 outputs the signal to a load 90, shown in FIG. 5 as an antenna.

Some of signal 32 is reflected from antenna 90. The power of the reflected signal may depend on the VSWR of load 90. This reflected signal, represented by signal 102, is passed though second port 80 to second circulator 30, via the second port of second circulator 30. Because reflected signal 102 is input into the second port of second circulator 30, reflected signal 102 is output from the third port of second circulator 102, such output being represented as signal 36. Similar to the leakage signal 24 output from first circulator 20, second circulator 30 also outputs a leakage signal from its third port, the leakage signal represented by signal 34. The combination of leakage signal 34 and signal 36, represented by signal 38, constitutes the total signal output from the third port of second circulator 30.

Without a cancellation signal present in system 10, signal 38 would then be input into a second port of third circulator 40, which would then output, via a third port, a signal 42 to third port 100, which would pass signal 42 to receiver 110. During instances when signals are being simultaneously transmitted and received via system 10, signal 42 is undesirable as it may interfere with a desired signal received by antenna 90. To prevent such occurrences, system 10 generates signal 44 to cancel signal 38.

The generation of signal 44 begins with the modification of signal 24 from first circulator 20. Filter 50 is configured to modify the phase and amplitude of signal 24 to produce a modified first signal 52, which is output to the first port of third circulator 40. Filter 50 may be a passive network having lumped, distributed, and resistive elements, as discussed in more detail with reference to FIG. 6. The amplitude of modified first signal 52 is equal to, or about equal to, the amplitude of signal 38. The phase of modified first signal 52 is exactly 180 degrees, or about 180 degrees, out of phase with the phase of signal 38. Third circulator 40 is configured to output, via a second port, modified first signal 52, represented by signal 44, towards second circulator 30. The combination of signals 44 and 38 results in a cancellation of both signals.

Figure 6:
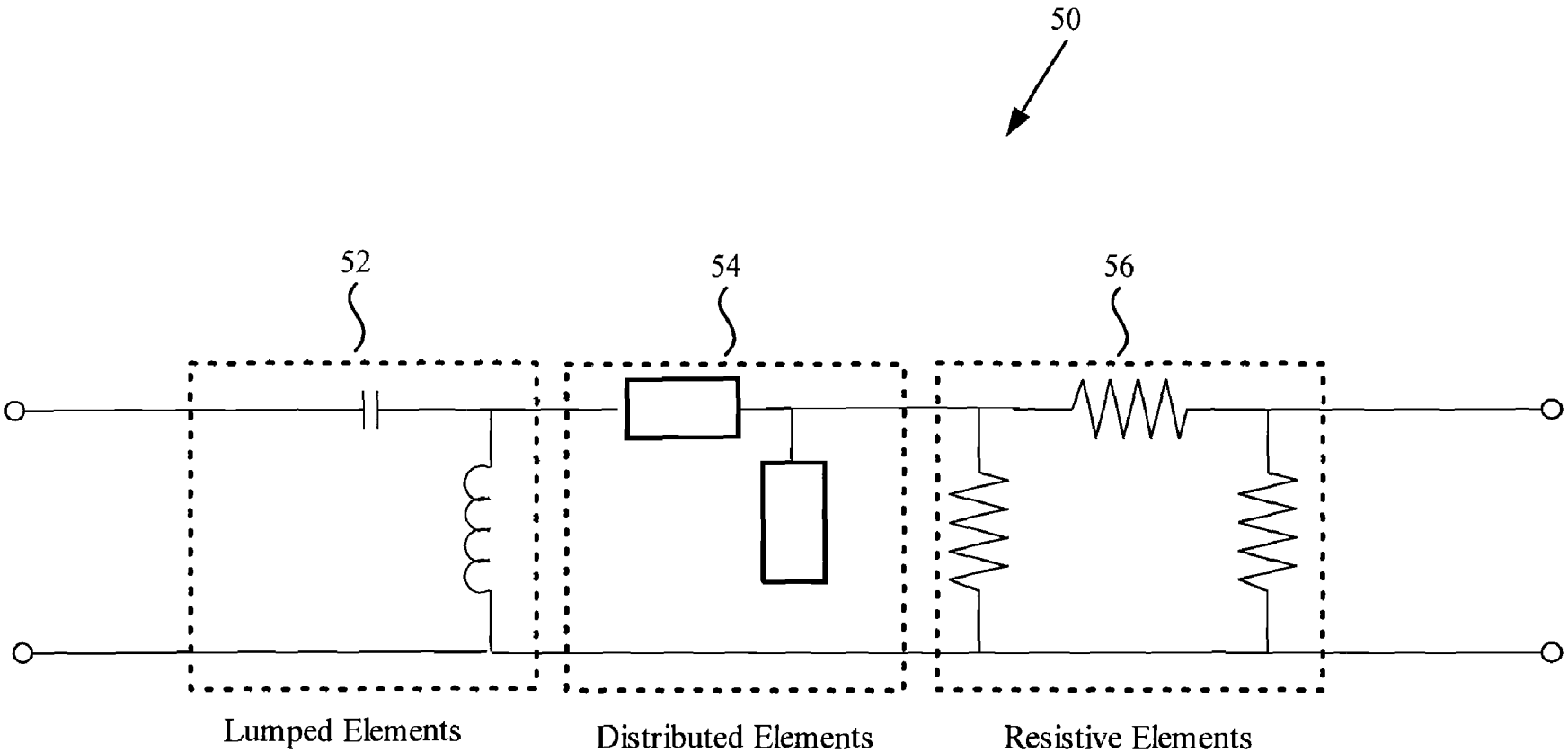
FIG. 6 shows a diagram of an embodiment of a filter configuration for use with a system in accordance with the Circulator Canceller with Increased Channel Isolation.

FIG. 6 shows a diagram of an embodiment of filter 50. Filter 50 may include lumped elements 52, distributed elements 54, and resistive elements 56. As an example, lumped elements 52 may include inductors, capacitors and transformers, distributed elements 54 may include series, shunt open, and shunt shorted transmission lines, and resistive elements may include resistors. Lumped elements 52, distributed elements 54, and resistive elements 56 may be arranged in various designs, so long as signal 24 from first circulator 20 is modified to cancel signal 38 from second circulator 30. Examples of filter designs for filter 50 may be found in the textbook *Microwave Engineering* by David M. Pozar, Wiley Publishing, $2^{nd}$ edition, 1997.

Figure 7:
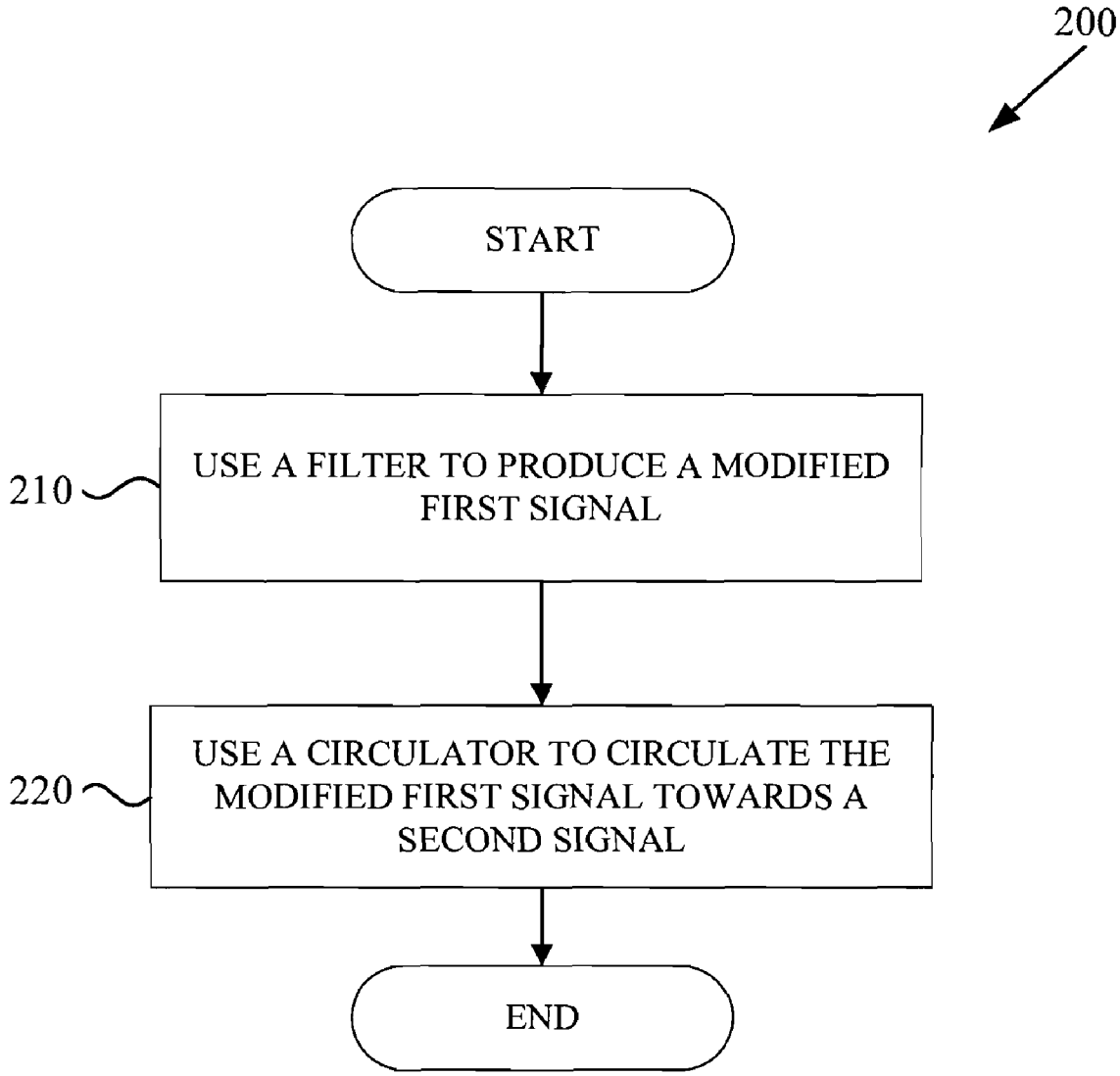
FIG. 7 shows a flowchart of an embodiment of a method in accordance with the Circulator Canceller with Increased Channel Isolation.

FIG. 7 shows a flowchart of an embodiment of a method 200 in accordance with the Circulator Canceller with Increased Channel Isolation. Method 200 may be performed by a system such as system 10 as shown in FIG. 5 and discussed herein. Method 200 may begin at step 210, which involves using a filter, such as filter 50, to produce a modified first signal 52 by modifying the phase and amplitude of a first signal 24 such that the amplitude of modified first signal 52 is approximately equal to the amplitude of a second signal 38, and the phase of modified first signal 52 is about 180 degrees out of phase with the phase of second signal 38. First signal 24 may be output from a first circulator, such as circulator 20, and second signal 38 may be output from a second circulator, such as circulator 30. Second signal 38 may comprise the combination of a reflected signal 36 from a load 90, such as an antenna, connected to second circulator 30 and a coupled signal 34 from second circulator 30. Step 220 may then involve using a third circulator, such as circulator 40 to circulate modified first signal 52 towards second signal 38.

Many modifications and variations of the Circulator Canceller with Increased Channel Isolation are possible in light of the above description. Within the scope of the appended claims, the Circulator Canceller with Increased Channel Isolation may be practiced otherwise than as specifically described. Further, the scope of the claims is not limited to the implementations and embodiments disclosed herein, but extends to other implementations and embodiments as may be contemplated by those having ordinary skill in the art.

We claim:

1. A system comprising:

a first circulator;

a second circulator connected to the first circulator and a load;

a third circulator connected to the second circulator; and a filter connected between the first circulator and the third circulator, the filter configured to modify the phase and amplitude of a first signal from the first circulator to produce a modified first signal, wherein the amplitude of the modified first signal is approximately equal to the amplitude of a second signal from the second circulator and the phase of the modified first signal is about 180 degrees out of phase with the phase of the second signal wherein the third circulator is configured to circulate the modified first signal towards the second circulator.

2. The system of claim 1, wherein the first signal comprises a coupled signal from the first circulator.

3. The system of claim 1, wherein the second signal comprises the combination of a reflected signal from the load and a coupled signal from the second circulator.

4. The system of claim 1, wherein the filter is configured to modify the amplitude of the first signal such that the amplitude of the modified first signal is equal to the amplitude of the second signal.

5. The system of claim 1, wherein the filter is configured to modify the phase of the first signal such that the phase of the modified first signal is exactly 180 degrees out of phase with the phase of the second signal.

6. The system of claim 1, wherein the load is an antenna.

7. The system of claim 1, wherein the filter is a passive network having lumped, distributed, and resistive elements.

8. The system of claim 1, wherein the first circulator, the second circulator, and the third circulator are broadband channelized circulators.

9. The system of claim 1, wherein the first circulator, the second circulator, and the third circulator are three-port clockwise circulators.

10. The system of claim 1, wherein the first circulator is connected to a transmit subsystem and the third circulator is connected to a receive subsystem.

11. A system comprising:

a first circulator connected to a transmit subsystem;

a second circulator connected to the first circulator and an antenna;

a third circulator connected to the second circulator and a receive subsystem; and a filter connected between the first circulator and the third circulator, the filter configured to modify the phase and amplitude of a first signal from the first circulator to produce a modified first signal, wherein the amplitude of the modified first signal is approximately equal to the amplitude of a second signal from the second circulator and the phase of the modified first signal is about 180 degrees out of phase with the phase of the second signal wherein the third circulator is configured to circulate the modified first signal towards the second circulator, the first signal comprises a coupled signal from the first circulator, and the second signal comprises a signal reflected from the load and a coupled signal from the second circulator.

12. The system of claim 11, wherein the first circulator, the second circulator, and the third circulator are broadband channelized circulators.

13. The system of claim 11, wherein the first circulator, the second circulator, and the third circulator are three-port clockwise circulators.

14. The system of claim 11, wherein the filter is a passive network having lumped, distributed, and resistive elements.

15. A method comprising the steps of:

using a filter to produce a modified first signal by modifying the phase and amplitude of a first signal such that the amplitude of the modified first signal is approximately equal to the amplitude of a second signal and the phase of the modified first signal is about 180 degrees out of phase with the phase of the second signal, wherein the first signal is output from a first circulator and the second signal is output from a second circulator; and using a third circulator to circulate the modified first signal towards the second signal.

16. The method of claim 15, wherein the filter is a passive network having lumped, distributed, and resistive elements.

17. The method of claim 15, wherein the first circulator, the second circulator, and the third circulator are broadband channelized circulators.

18. The method of claim 15, wherein the first circulator, the second circulator, and the third circulator are three-port clockwise circulators.

19. The method of claim 15, wherein the second signal comprises the combination of a reflected signal from a load connected to the second circulator and a coupled signal from the second circulator.

20. The method of claim 19, wherein the load is an antenna.

* * * * *